US005168816A

United States Patent [19]

Hutchens et al.

[11] Patent Number: 5,168,816

[45] Date of Patent: Dec. 8, 1992

[54] SLUDGE CAR

[76] Inventors: Michael R. Hutchens, 115 Maple Drive, Box 247, Treynor, Iowa 51575; Steven C. Beckwith, 1325 So. 80th St., Omaha, Nebr. 68124

[21] Appl. No.: 638,746

[22] Filed: Jan. 8, 1991

[51] Int. Cl.[5] ..... B61D 7/00

[52] U.S. Cl. ..... 105/248

[58] Field of Search ..... 105/247, 248; 222/544; 406/50, 191, 192, 193

[56] References Cited

U.S. PATENT DOCUMENTS

| | | | |
|---|---|---|---|
| 2,190,727 | 2/1940 | McKenna | 105/247 |
| 3,252,431 | 5/1966 | Phillips | 105/248 |
| 3,325,177 | 6/1967 | Welinder | 105/247 |
| 3,420,419 | 1/1969 | Haslett | 105/248 |
| 3,456,834 | 7/1969 | Paton | 105/248 |
| 4,101,175 | 7/1978 | Kull | 105/248 |
| 4,352,331 | 10/1982 | Anderson et al. | 105/248 |

FOREIGN PATENT DOCUMENTS

| | | | |
|---|---|---|---|
| 0675440 | 12/1963 | Canada | 105/248 |
| 0437516 | 4/1926 | Fed. Rep. of Germany | 105/248 |
| 1204253 | 11/1965 | Fed. Rep. of Germany | 105/247 |
| 1123913 | 11/1984 | U.S.S.R. | 105/248 |

*Primary Examiner*—Douglas C. Butler
*Assistant Examiner*—Mark T. Le
*Attorney, Agent, or Firm*—Zarley, McKee, Thomte Voorhees & Sease

[57] ABSTRACT

A sludge car for hauling sewage lagoon sludge comprising a rail undercar having a car body mounted thereon which includes opposite ends and sides. The car body is provided with a plurality of individual hoppers each of which have sludge discharge ports at the lower ends thereof. A valve is associated with each of the discharge ports to permit the selective removal of sludge from the individual hoppers. A manifold is mounted beneath the car body and is in communication with each of the valves so that the sludge may be discharged from either side of the car body.

8 Claims, 5 Drawing Sheets

SLUDGE CAR

BACKGROUND OF THE INVENTION

This invention relates to a sludge car and more particularly to a covered hopper car which has been converted to enable sludge to be hauled by rail.

Many sewage lagoons have become filled with sludge thereby rendering the lagoon inoperable. It has been found that the sludge may be removed from the lagoon and applied as a fertilizer to fields, pastures, etc. In many cases, the sludge must be transported considerable distances from the lagoons to the fields. It has been determined that the most economical method of transportation is by rail. However, to applicants' knowledge, no environmentally sound rail transport system was heretofore available for transporting the sludge from the lagoon to the remote location. Applicants have discovered that a conventional covered hopper car may be converted to accommodate sludge for transportation to a remote facility.

It is therefore a principal object of the invention to provide a sludge car for hauling sewage lagoon sludge by rail.

A further object of the invention is to provide a converted hopper car for hauling sludge by rail.

Still another object of the invention is to provide a sludge car including a plurality of individual hoppers therein which may be selectively emptied from either side of the car.

Still another object of the invention is to provide a sludge car including a manifold means for emptying the sludge therefrom with the manifold means including covered expansion joints to protect the manifold from damage upon twisting of the hopper car as it travels over the rails.

Still another object of the invention is to provide a sludge car which is environmentally safe to use.

Still another object of the invention is to provide a sludge car wherein the contents thereof may be conveniently unloaded therefrom.

These and other objects of the present invention will be apparent to those skilled in the art.

SUMMARY OF THE INVENTION

A covered hopper car is provided for hauling sewage lagoon sludge by rail from the sewage lagoon to a remote rail siding where the sludge may be pumped from the sludge car and then transported to a field, pasture, etc. where it is applied thereto as a fertilizer. The covered hopper car includes a hopper car body which is mounted on a rail undercar with the hopper car body including a plurality of individual hoppers positioned in an end-to-end relationship. Each of the hoppers has a discharge port at its lower end which has a valve mounted thereon so that the individual hoppers may be selectively emptied. A manifold operatively interconnects each of the valves at the lower ends of the hoppers to enable the sludge to be discharged from either side of the sludge car. The manifold includes covered expansion joints to prevent damage to the manifold upon the twisting of the car as the car moves over the rails.

DESCRIPTION OF THE PREFERRED EMBODIMENT

Figure 1:
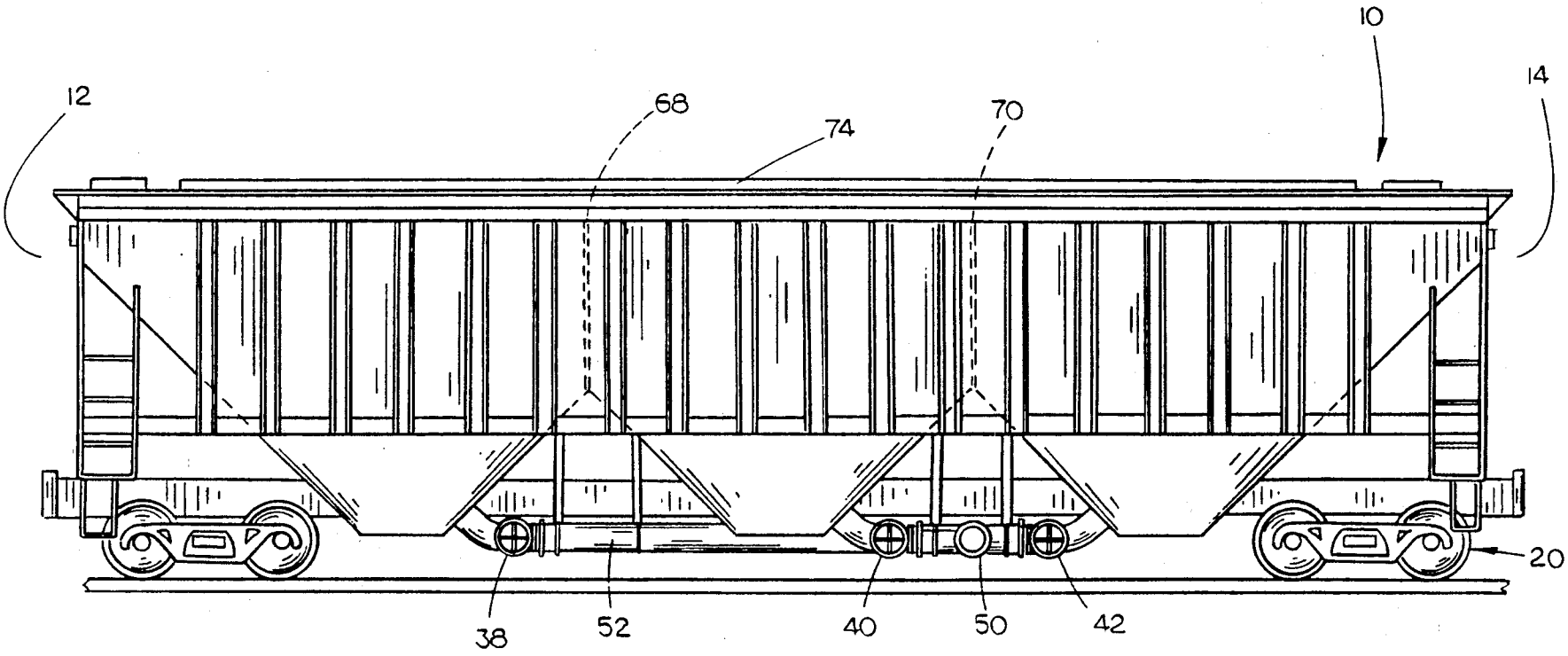
FIG. 1 is a side elevational view of the sludge car of this invention.
Figure 2:
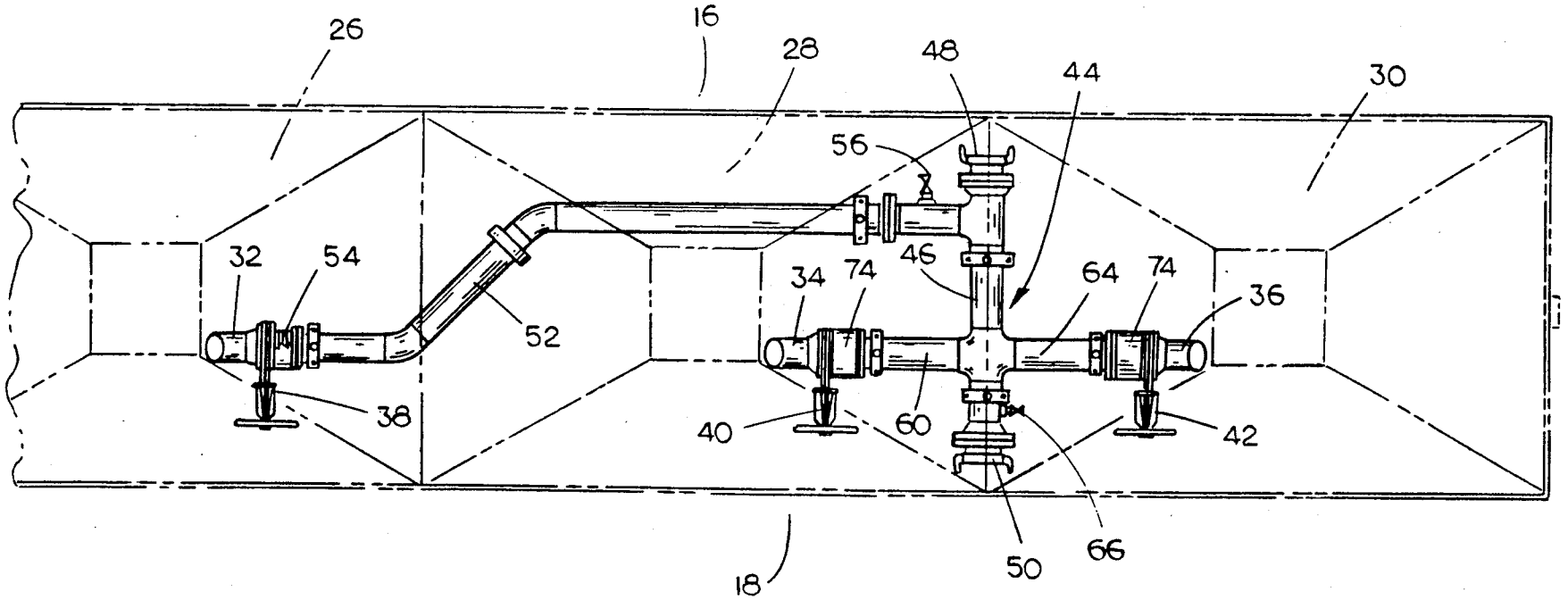
FIG. 2 is a plan view of the manifold system which is connected to each of the individual hoppers which are shown in phantom lines.
Figure 3:
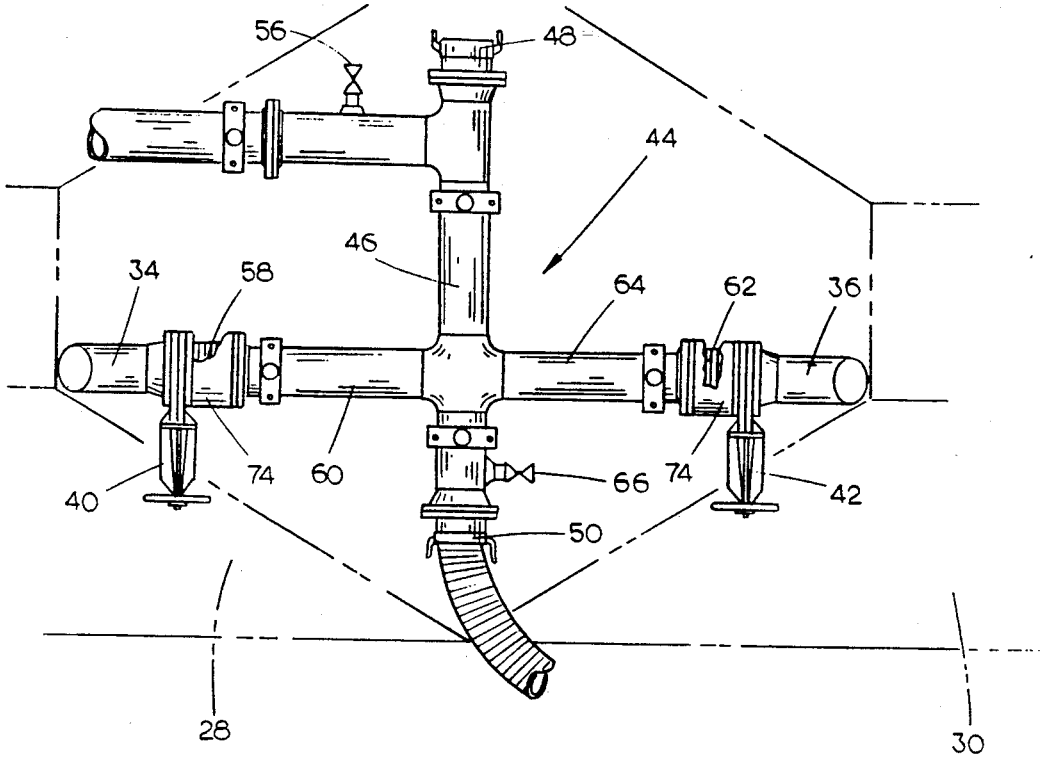
FIG. 3 is a plan view of a portion of the manifold system.
Figure 4:
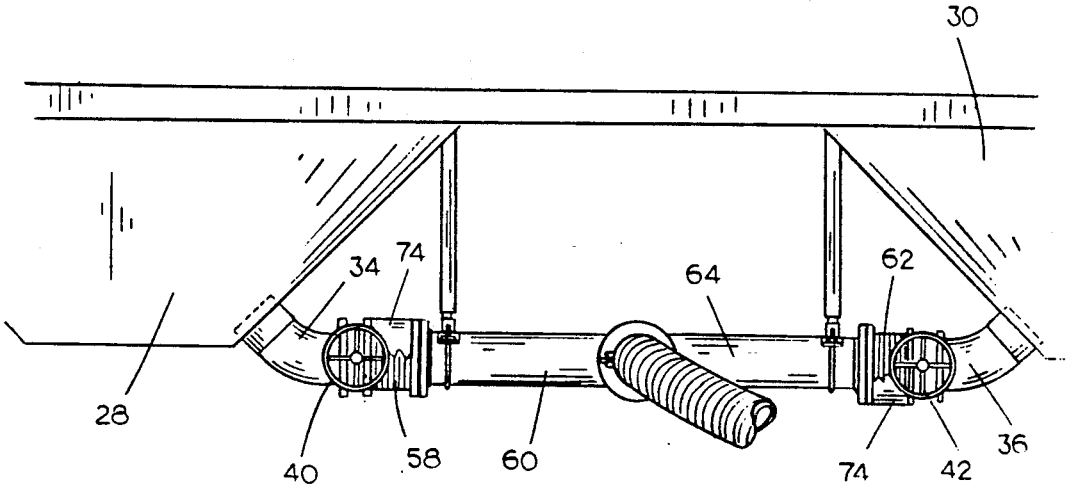
FIG. 4 is a side view of a portion of the manifold system.

Referring to FIG. 1, the numeral 10 refers generally to the sludge car of this invention. Sludge car 10 is created by modifying a conventional covered hopper car including opposite ends 12 and 14 and opposite sides 16 and 18. The car 10 includes a conventional rail undercar means 20 adapted to move over the rails 22 and 24. The conventional hopper car includes a plurality of hoppers or hopper bins which will be described as hoppers 26, 28 and 30 which have upper and lower ends. In some hopper cars, more or less hoppers will be utilized. The lower ends of the hoppers of the hopper car normally are provided with outlet gates provided at the lower ends thereof with the gates being mounted on tracks so that the lower ends of the hoppers may be opened to dump the material within the hopper. The conventional hopper car is converted by burning or cutting the outlet gate tracks from the lower ends of the hopper and then welding the outlet gate plates to the bottom of the hoppers to ensure that the car and the hopper is water tight.

It is important that is possible to discharge the sludge from the individual hoppers from either side of the car. The hopper car is thus modified as will be described as follows.

Hoppers 26, 28 and 30 are provided with discharge ports or discharge pipes 32, 34 and 36 respectively which are in communication with the interiors of the lower ends of the hoppers and which extend outwardly therefrom. Valves 38, 40 and 42 are associated with the pipes 32, 34 and 36 respectively to permit the selective removal of sludge from the individual hoppers.

The numeral 44 refers generally to a manifold means which is provided to permit the removal of the sludge from either side of the car at the bottom thereof. Manifold 44 includes a first pipe 46 which extends transversely beneath the hopper car and which has quick connect couplings 48 and 50 at its outer ends. Pipe 52 has one end operatively connected to pipe 46 and its other end operatively connected to an expansion joint 54 which is imposed between the end of pipe 52 and valve 38. Pipe 52 is also provided with a ball valve-nipple means 56 to permit air or fluid to be introduced into the interior of the pipe 52 to loosen compacted sludge therein or to loosen compacted sludge within hopper 26.

Expansion valve 58 is imposed between valve 40 and pipe 60 which is in operative communication with pipe 46. Similarly, expansion joint 62 is imposed between valve 42 and pipe 64 which is in operative communication with pipe 46. Pipe 46 is also provided with a ball valve-nipple means 66 to enable air or fluid to be introduced into the interior of pipe 46 to loosen compacted sludge within pipe 60 and 64 and the hoppers 28 and 30.

Figure 6:
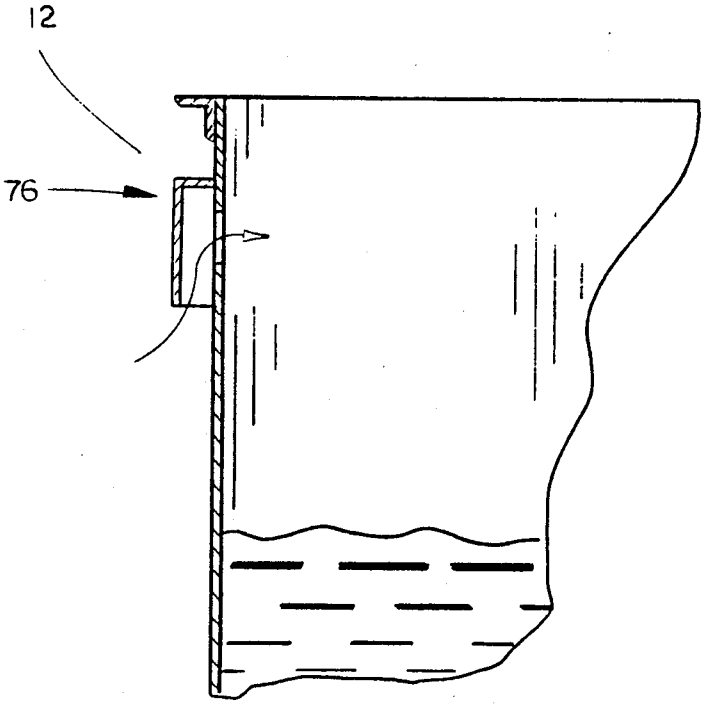
FIG. 6 is an enlarged sectional view seen on lines 6—6 of FIG. 5.
Figure 5:
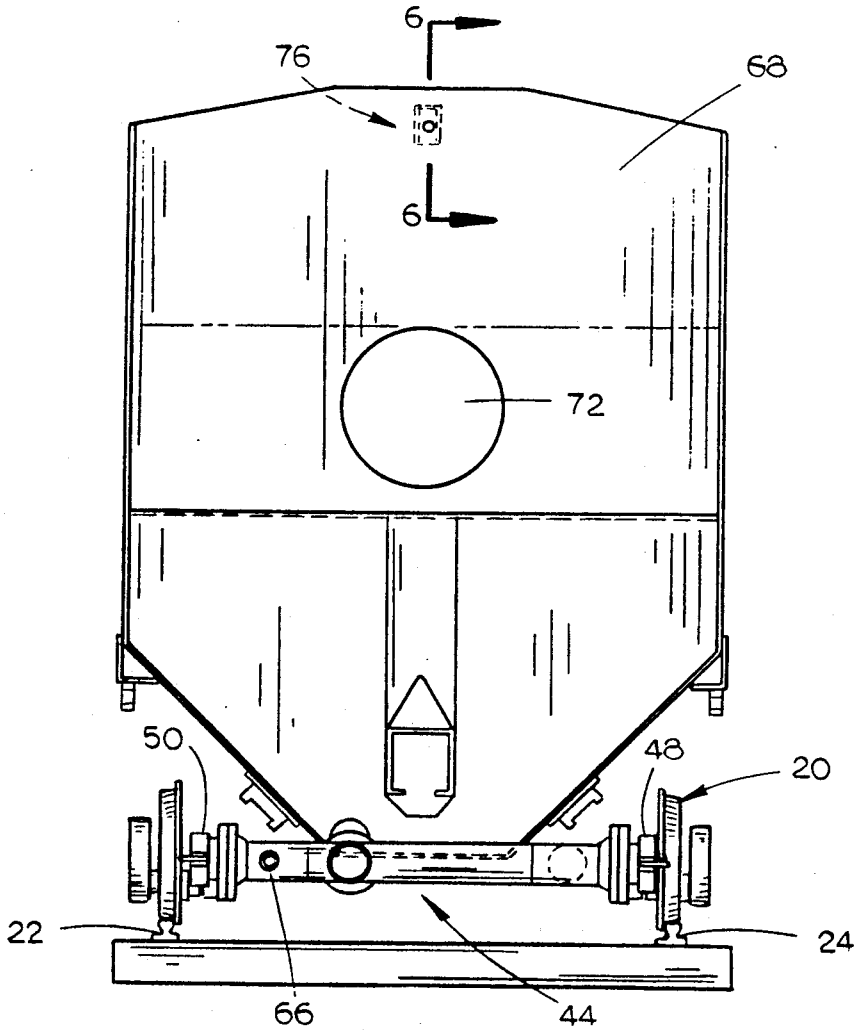
FIG. 5 is an end view of the sludge car of this invention.
Figure 7:
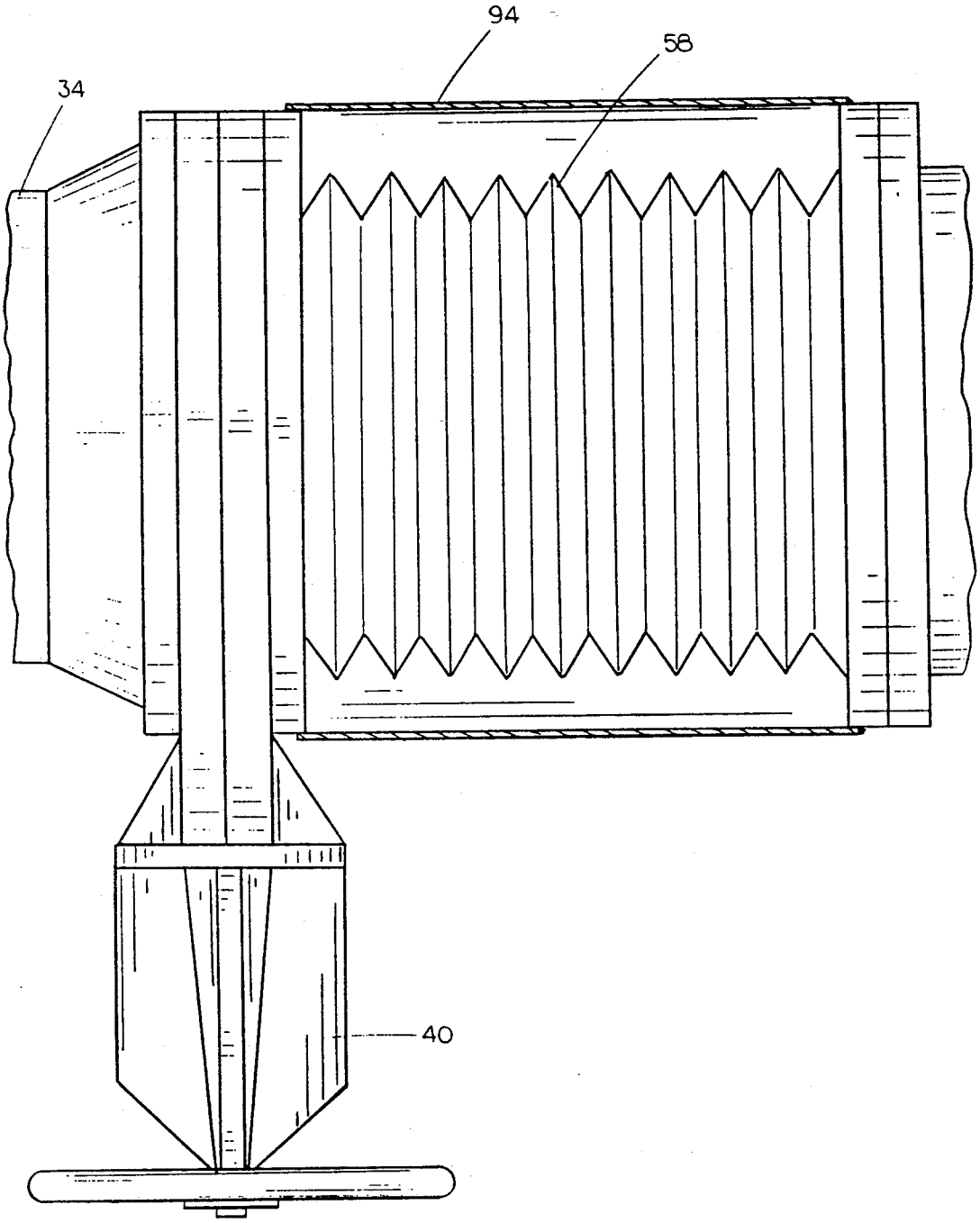
FIG. 7 is a sectional view of one of the shielded expansion joints.

One end of the hopper oar 10 is provided with an air vent 76 as seen in FIG. 6 to permit the venting of the interior of the sludge car. It should be noted that the partition walls 68 and 70 which separate adjacent hoppers are provided with an opening 72 formed therein to permit communication of the sludge between the upper ends of the individual hoppers. The sludge car 10 is provided with a conventional hatch means 74 at the upper end thereof which may be opened to permit the sludge to be placed in the individual hoppers.

Thus, the sludge may be pumped into the individual hoppers of the sludge car through the hatch means 74. The sludge car may then be transported by rail to a remote location where the sludge may be pumped from the hoppers. A conventional unloading system may be connected to either of the couplings 48 and 50 to permit the sludge to be discharged from either side of the car since at some locations, one side of the car or the other may be inaccessible.

The valves 38, 40 and 42 may be selectively opened to permit the sludge to be discharged from the respective hoppers. Further, the individual valves 38, 40 and 42 may be selectively closed to isolate any hopper compartment to prevent the pneumatic unloading system from sucking air from one of the hoppers should that particular hopper be the first to be emptied.

The protected expansion joints 54, 58 and 62 are quite important inasmuch as the car tends to rack and twist during movement over the rails. The expansion joints prevent damage to the manifold system and the protective shields 94 positioned thereover protect the expansion joint from the rail bed ballast.

If the sludge should become compacted in the manifold or within the individual hoppers, air may be introduced into the system through the valves 56 and 66 to loosen the same.

Thus it can be seen that the invention accomplishes at least all of its stated objectives.

We claim:

1. A covered hopper car for hauling sewage lagoon sludge by rail, comprising:

a rail undercar means, a hopper car body mounted on said rail undercar means and including opposite ends and opposite sides, said hopper car body including a plurality of individual hoppers having upper and lower ends, each of said hoppers having a sludge discharge port at its lower end, a valve means associated with each of said discharge ports to permit the selective removal of sludge from the individual hoppers, a manifold means mounted beneath said hopper car body and being in communication with each of said valves, said manifold means including means for discharging sludge from either side of said hopper car body;

said manifold means including expansion joints positioned downstream of each of said first valves;

said expansion joints being completely enclosed within a protective shield to prevent damage from road bed ballast, and adjacent individual hoppers being separated by partitions and an opening formed in each of said partitions, above the lower end of said hopper, located to permit sludge communication between adjacent hoppers.

2. The covered hopper car of claim 1 wherein said manifold means includes valving to permit the selective discharge of sludge from either side of said hopper car body.

3. The hopper car body of claim 1 wherein said hopper car body is provided with first, second and third hoppers positioned in an end-to-end relationship on said hopper car body and said manifold means comprises a first quick connect coupling at one side of said hopper car body, a second quick connect coupling at the other side of said hopper car body, a first pipe means connecting said first and second couplings, a second pipe means connecting said valve at the lower end of said first hopper to said first pipe means, a third pipe means connecting said valve at the lower end of said second hopper to said first pipe means, and a fourth pipe means connecting the valve at the lower end of said third hopper with said first pipe means.

4. The hopper car body of claim 3 wherein said manifold means includes means for introducing air thereinto whereby compacted sludge in said manifold means or said hoppers may be loosened.

5. The hopper car body of claim 3 wherein a first expansion joint is positioned between the valve at the lower end of said first hopper and said second pipe means, a second expansion joint positioned between the valve at the lower end of said second hopper and said third pipe mans, and a third expansion joint positioned between the valve at the lower end of said third hopper and said fourth pipe means.

6. The hopper car body of claim 5 wherein each of said expansion joints are enclosed within a protective shield.

7. The hopper car body of claim 1 wherein an air vent means is provided on said hopper car body which is in communication with the interiors of said hoppers.

8. The hopper car body of claim 3 wherein said manifold means includes means for introducing fluid thereinto whereby compacted sludge in said manifold means or said hoppers may be loosened.

* * * * *